US009022124B2

(12) United States Patent
Sorensen et al.

(10) Patent No.: US 9,022,124 B2
(45) Date of Patent: May 5, 2015

(54) WELL INTERVENTION

(75) Inventors: Bjorn Bro Sorensen, Balestrand (NO); Bjarne Langeteig, Balestrand (NO); Jostein Alvaern, Balestrand (NO)

(73) Assignee: Quality Intervention AS, Balestrand (NO)

( * ) Notice: Subject to any disclaimer, the term of this patent is extended or adjusted under 35 U.S.C. 154(b) by 0 days.

(21) Appl. No.: 13/817,684

(22) PCT Filed: Aug. 22, 2011

(86) PCT No.: PCT/GB2011/051580

§ 371 (c)(1),
(2), (4) Date: Apr. 18, 2013

(87) PCT Pub. No.: WO2012/022987

PCT Pub. Date: Feb. 23, 2012

(65) Prior Publication Data

US 2013/0199793 A1 Aug. 8, 2013

(30) Foreign Application Priority Data

Aug. 20, 2010 (GB) ..... 1014035.8

(51) Int. Cl.
*E21B 19/22* (2006.01)
*E21B 33/035* (2006.01)
*E21B 33/076* (2006.01)

(52) U.S. Cl.
CPC ..... *E21B 33/035* (2013.01); *E21B 19/22* (2013.01); *E21B 33/076* (2013.01)

(58) Field of Classification Search
CPC ..... E21B 19/22; E21B 33/035; E21B 33/076
USPC ..... 166/351, 350, 352, 385, 77.1, 77.2, 166/241.5, 241.6; 405/168.3, 183.5, 224.2, 405/224.3; 138/118, 177, 178
See application file for complete search history.

(56) References Cited

U.S. PATENT DOCUMENTS 3,568,767 A * 3/1971 Weiss ..... 166/351
4,416,329 A 11/1983 Tanner et al.

(Continued)

FOREIGN PATENT DOCUMENTS

EA 200870228 A1 2/2009
GB 996063 6/1965

(Continued)

OTHER PUBLICATIONS

International Search Report of International Application No. PCT/GB2011/051580 dated Apr. 18, 2012.

(Continued)

*Primary Examiner* — Matthew Buck
(74) *Attorney, Agent, or Firm* — Fay Sharpe LLP

(57) ABSTRACT

A method of well intervention in a subsea well having a wellhead on the sea floor includes extending an intervention hose downwardly through the sea from a hose drum installed on a vessel on the sea surface into the well through a subsea intervention stack installed on the wellhead. The intervention hose is exposed directly to the ambient sea between the vessel and the top of the subsea intervention stack. In a method of well intervention, an intervention hose extends from a hose drum and into a well. The hose is driven out of the well without the use of an injector by pulling the hose out of the well with the hose drum. In a method of well intervention, an intervention hose extends from a hose drum towards a wellhead, with the hose being guided downward from the drum towards the wellhead by a guiding sheave.

15 Claims, 3 Drawing Sheets

(56) References Cited

U.S. PATENT DOCUMENTS

| | | | | | |
|---|---|---|---|---|---|
| 4,515,211 | A * | 5/1985 | Reed et al. | 166/77.1 |
| 4,577,693 | A * | 3/1986 | Graser | 166/338 |
| 4,673,041 | A * | 6/1987 | Turner et al. | 166/340 |
| 4,825,953 | A * | 5/1989 | Wong et al. | 166/338 |
| 4,899,816 | A * | 2/1990 | Mine | 166/85.5 |
| 4,915,178 | A * | 4/1990 | Goldschild | 166/385 |
| 4,940,095 | A * | 7/1990 | Newman | 166/378 |
| 4,993,492 | A * | 2/1991 | Cressey et al. | 166/339 |
| 5,088,559 | A * | 2/1992 | Taliaferro | 166/379 |
| 5,828,003 | A | 10/1998 | Thomeer et al. | |
| 6,148,925 | A * | 11/2000 | Moore | 166/384 |
| 6,202,764 | B1 * | 3/2001 | Ables et al. | 175/162 |
| 6,843,321 | B2 * | 1/2005 | Carlsen | 166/355 |
| 7,431,092 | B2 * | 10/2008 | Haheim et al. | 166/343 |
| 7,686,073 | B1 | 3/2010 | Reynolds | |
| 7,845,412 | B2 * | 12/2010 | Sbordone et al. | 166/368 |
| 8,387,701 | B2 * | 3/2013 | Sbordone | 166/338 |
| 8,439,109 | B2 * | 5/2013 | Sbordone | 166/250.01 |
| 2002/0125014 | A1 | 9/2002 | Dearing et al. | |
| 2003/0075361 | A1 | 4/2003 | Terry et al. | |
| 2004/0040749 | A1 | 3/2004 | Terry et al. | |
| 2005/0189029 | A1 * | 9/2005 | Quigley et al. | 138/125 |
| 2006/0283605 | A1 | 12/2006 | Wood et al. | |
| 2006/0289171 | A1 | 12/2006 | Wood et al. | |
| 2007/0175642 | A1 | 8/2007 | Shampine et al. | |
| 2009/0218106 | A1 | 9/2009 | Stukey et al. | |
| 2010/0294479 | A1 * | 11/2010 | Shee | 166/65.1 |

FOREIGN PATENT DOCUMENTS

| | | | |
|---|---|---|---|
| RU | 2166057 | C2 | 4/2001 |
| RU | 2344963 | C2 | 1/2009 |
| SU | 642472 | A1 | 1/1979 |
| SU | 1052437 | A1 | 11/1983 |
| SU | 1059149 | A | 12/1983 |
| SU | 1154462 | A1 | 5/1985 |
| SU | 1385178 | A1 | 3/1988 |
| WO | WO 01/61145 | A1 | 8/2001 |
| WO | WO 02/20938 | A1 | 3/2002 |
| WO | WO 2006/014417 | A2 | 2/2006 |
| WO | WO 2007/061747 | | 5/2007 |
| WO | WO 2009/016346 | A2 | 2/2009 |
| WO | WO 2009/141160 | A2 | 11/2009 |
| WO | WO 2010/019675 | A2 | 2/2010 |
| WO | WO 2010/030190 | A2 | 3/2010 |
| WO | WO 2010/089725 | A2 | 8/2010 |

OTHER PUBLICATIONS

Journal Publication entitled "*Coiled Tubing Well Control Equipment Systems*", API Recommended Practice 16ST,First Edition, Mar. 2009, pp. 1-75.

Photographs, Circa 2005.

Presentation with Photographs, Circa 2009.

Eurasian Search Report of corresponding Application No. EA 201390239 dated Jan. 22, 2013.

"R&D Results for Tomorrow", DEMO 2000, Dec. 2002, 36 p.

International Search Report of International Application No. GB1014035.8 Dated Nov. 8, 2010.

International Search Report International Application No. GB1014035.8 Dated Mar. 3, 2011.

Hewlett et al., "Multi-Service Vessel Well Intervention With New SILS", OTC 15178, May 5-8, 2003, 10 p.

Moller et al., "Cost Efficient Well Interventions", STATOIL, Jan. 18, 2008, 31 p.

"Subsea Well Intervention", RPSEA Presentation, Schlumberger, Oct. 31, 2006, 33 p.

"Leading the LWI pack", Offshore Engineer, Aug. 2007, p. 39-42, www.offshore-engineer.com.

Tryland, R.T., "LWI (Light Well Interventions) in Statoil, Experiences and Future Developments", Subsea Houston Conference, Sep. 20-22, 2005, 23 p.

Berle, K. I., "Riserless Light Well Intervention (RLWI) and Evaluation of Downhole Operations from the 2006 RLWI Campaign", Master Thesis, Norwegian University of Science and Technology, Jun. 22, 2007, 133 p.

"Thermoplastic Composite Pipe, An Alternative for Coiled Tubing", Airborne Composite Tubulars B.V., 2009, 5 p., www.airbornetubulars.com.

"Products: Coiled Tubing", Airborne International B.V., Aug. 17, 2010, 2 p., www.airborneinternational.com/products/coiled-tubing.

"Capillary Units and Injectors", National Oilwell Varco, Aug. 17, 2010, 2 p., www.nov.com/Well_Service_and_Completion/Coiled_Tubing/Coiled_Tubing_Equipment/Capillary_Units.aspx.

"Capillary Injector Head", Wellhead Control Products, Aug. 13, 2010, 2 p., www.wellheadcontrol.com/capillary.htm.

"Coiled Tubing", Wikipedia, Jul. 12, 2010, 4 p., http://en.wikipedia.org/wiki/Coiled_tubing.

Jorgensen, Lett brønnintervensjon (English title: Light Well Intervention), Jul. 14, 2010, 14 p.

"Coiled Tubing: String Design and Mechanical Behavior, Materials Fit for Purpose", Precision Tube Technology, Oct. 21, 1999, 24 p.

Intervensjon i Havbunnskompletterte Brønner; Nåtid og Fremtid (English Title: Intervention in Subsea Wells, Present and Future, Island Offshore, Sep. 24, 2008, 25 p.

* cited by examiner

WELL INTERVENTION

The invention relates to a method of well intervention and to well intervention apparatus. The intervention may be carried out on land or sea based oil or gas rigs.

Well interventions are remedial operations that are performed on oil or gas producing wells with the intention of restoring or increasing production. There are three main types of well intervention, namely wireline intervention, coiled tubing intervention and hydraulic work over intervention. The wireline technique involves running a cable into the well from a platform deck or a vessel. An intervention tool string is attached to the wire and the weight of the tool string, plus additional weighting if necessary, is used to run the wire into the well, where the tool string performs a maintenance or service operation. Wireline intervention is carried out in wells under pressure. The wire is supplied from a drum and passes via two sheaves to a stuffing box which is exposed to well pressure on its well side. Wireline intervention is a light well intervention process.

Coiled tubing intervention is a medium well intervention process, requiring the use of a larger space or deck. It has the advantage over wireline intervention that it provides a hydraulic communication path to the well, but uses heavier and more costly equipment and requires more personnel.

The coiled tubing is a length of continuous tubing supplied on a reel. The outside diameter of the tubing ranges from small sizes of about 3 cm (so-called capillary tubing) up to 8 or 9 cm. The tubing is fed from the reel upwardly to a tubing guide, known as a goose neck, and from there via an injector downwardly towards the well.

The goose neck typically consists of an arch serving to transfer the direction of the tubing from the inclined direction as it comes off the reel to the required vertical direction as it descends towards the well. The arch is provided with a series of rollers spaced along the length of the tubing and to reduce friction as the tubing passes along the arch.

Coiled tubing is usually manufactured from steel alloy and is much heavier and larger than wireline. An injector head is required to push or "snub" the tubing into the well, and to pull it out of the well when an intervention job has been completed.

A typical injector consists of a pair of endless chains each mounted on a pair of spaced sprockets and each having a straight run engaging the coiled tubing. The tubing is compressed between the chains which are hydraulically driven to push the tubing downwardly or pull it upwardly.

Another type of injector involves the use of a driven sheave over which the tubing passes and a series of rollers which are arranged along an arch and which push the tubing against the driven sheave. This type of injector head is known for use with small diameter tubing, or capillary tubing, of the order of 1 cm diameter. The pulling force which it can impart to the tubing is 5,000 lbf (22, 240 Newtons) or more. This type of injector both changes direction or bends the tubing, and imparts force to the tubing at the same time It is thus conventional to use coiled tubing made of steel and to use a heavy duty injector to drive the coiled tubing downwardly into a well and to pull it out again. In recent times thermoplastic coiled tubing has been proposed. This tubing is lighter than steel and its greater ductility means that it suffers less from fatigue during a lifetime involving multiple operations. However, the industry has continued to use traditional injector methods based on steel coiled tubing for handling the thermoplastic tubing.

With particular reference to offshore well interventions, it has been proposed to carry these out using coiled tubing which extends from a floating vessel to a subsea intervention stack without being inside a conventional riser. Such a system has been proposed as the SWIFT system. In this system a flexible riser is provided by an external coiled tubing and a smaller coiled tubing is inserted through the flexible riser into the well for normal coiled tubing operations. The internal coiled tubing acts as an intervention hose. An injector is provided on the vessel to drive the internal coiled tubing downwardly, and the external coiled tubing acts as a guide to prevent buckling of the internal tubing during this process. The injector is also used to pull the internal coiled tubing up out of the well.

Viewed from one aspect, the invention provides a method of well intervention in a subsea well having a well head on the sea floor, in which an intervention hose extends downwardly through the sea from a drum installed on a vessel on the sea surface into the well through a subsea intervention stack installed on the well head at the sea floor, and in which the intervention hose is exposed directly to the ambient sea between the vessel and the top of the subsea intervention stack.

With such a method, the intervention hose may be driven out of the well using the hose drum. Thus an injector is not required on the vessel, nor a riser or hose guide down to the sea floor. In order to drive the hose into the well, the weight of a tool string, and/or additional weighting, and/or a tractor may be used. Alternatively, or additionally, a relatively light duty drive system at the top of the subsea intervention stack may be provided, as described herein. There is the significant advantage that the provision of a heavy duty injector (such as of the conventional chain drive type described above) at the sea floor is not needed. It is believed that the perceived need to provide such an injector in a subsea environment is a reason why riserless coiled tubing interventions have not been adopted in the industry.

Preferably, the said hose has sufficient flexibility and slack to allow limited movements of the said vessel due to forces from sea and wind without inducing movements to the lower part of the hose adjacent to the subsea intervention stack.

Preferably, the hose is driven out of the well without the use of an injector by pulling the hose out of the well with the hose drum.

Viewed from a second aspect, the invention provides a method of well intervention in which an intervention hose extends from a hose drum and into a well, wherein the hose is driven out of the well without the use of an injector by pulling the hose out of the well with the hose drum.

The inventors have recognised that there is no need for an injector to provide an upward pulling capacity, as this may be provided by pulling the hose directly with the hose drum. This is unlike known coiled tubing systems, which have coiled tubing injectors to provide all pulling forces in such systems. For clarification it should be mentioned that coiled tubing systems have a coiled tubing reel which provides sufficient pull on the run of tubing from the goose neck only to control the spooling of the tubing and prevent it from becoming a relaxed spring due to residual bending forces in the steel. The reel does not act to pull the tubing out of the well.

The comments below apply to any aspect of the invention described herein.

It is preferred to use a hose that is more flexible and lighter weight than traditional coiled tubing. For example non-metallic tubing may be used.

The hose material may be a non-metallic material such as plastics, e.g. thermoplastics. The hose material may be completely non-metallic or it may have a metal content which is less than 50 or 40 or 30 or 20 or 10% by volume. It will thus be relatively lightweight compared to traditional coiled tubing, which is made entirely of steel. A certain level of metal content may be desired, for example for strength or reinforcement, or to provide an electrically conductive path, whereby the hose can effect both hydraulic and electrical communication to a down hole tool string.

Thus, the hose may be entirely or partly made from plastics for example thermoplastics. A hose made from plastics, with or without a metal content, may include fibre reinforcement. For example the hose may be made from fibre reinforced tapes which are melt-fused onto a thermoplastic liner. Tubing which is suitable for use as such a hose has been proposed by Airborne Composite Tubulars B.V. and referred to as "Thermoplastic Composite Pipe (TCP)". Other examples of tubing which may be used as the intervention hose in the present invention are those supplied by Inplex Custom Extruders LLC and known for use down hole in gas lift operations.

By using lighter weight materials to construct the hose, it will have a lower density. Given that the hose will be in a fluid environment in a well (or in a riser, or in ambient sea water as discussed above), lower density materials may have a density similar to or possibly less than that of the fluid surrounding the hose. This will facilitate the process of driving the hose out of the well using the hose drum and without the use of an injector. In contrast, steel coiled tubing is considerably denser than the fluids in which it will be immersed and so its weight has to be overcome when driving the hose out of the well using an injector.

The external diameter of the hose is preferably less than or equal to 5 or 4 or 3 or 2 cm. One preferred external diameter is 1 inch (2.5 cm). Smaller diameter hoses have the advantage of requiring a hose drum and related equipment which can be smaller in size.

The weight of a tool string, possibly supplemented by additional weighting, can be used to lower the intervention hose into a well. A tractor may be used to pull the hose into the well. Tractors are known for use with wire line systems for this purpose, but in view of the lack of any hydraulic communication with the surface they are electrically powered. By using a hose, as in the present invention, hydraulic communication is available and so a tractor may be hydraulically powered. Hydraulically powered tractors are generally less expensive than electric tractors, in view of the reduced need to design them to avoid a sparking hazard.

The hose will normally pass via a stuffing box. In the case of low pressure wells, in order to deliver the hose into the well, the weight of the hose and that at the end of the hose may be sufficient to pull the hose through the stuffing box. In higher pressure wells there will be an increased resistance to entry of the hose into the well and a drive system, such as a snubbing drive system, may then be used.

By using a hose with a relatively small external diameter, for example the diameters referred to above, the resistance to entry of the hose into the well via the stuffing box will be reduced. This has the advantage, compared to larger diameter traditional coiled tubing, that the snubbing drive capacity of any drive system can be relatively small.

In a preferred method, the hose extends through a seal which seals circumferentially round the outside of the hose (e.g. a stuffing box), and the method comprises using a drive system to push the hose through the seal (e.g. a snubbing drive). The drive system may be a light duty one, unlike traditional coiled tubing injectors. The pushing force provided by the drive system may be no more than 20,000 Newtons.

The drive system preferably does not change the direction of or bend the hose, unlike the second known injector described above.

The drive system may comprise a pair of rotational members, such as wheels or rollers, biased towards each other with the hose therebetween.

The known injectors described above engage coiled tubing over a significant length thereof, whereas the inventors have recognised that a simple pair of rotational members may be used to engage the hose and provide the necessary pushing force. Thus the drive system may engage the hose over a length thereof which is less than 30 cm, more preferably 20 cm, 10 cm or 5 cm. The drive system may comprise only one pair of rotational members biased towards each other with the hose therebetween.

The rotational members may be wheels, rollers or the like. They are preferably of equal diameter. Each rotational member may be provided with an external groove for receiving the hose. Each groove may extend for substantially half the cross-section of the hose. Each groove may have a part-circular cross-section, with a radius which is equal to or smaller than that of the hose.

In a preferred embodiment, the rotational members engage each other by externally circumferentially extending first portions and engage the hose by external circumferentially extending second portions, at least one of the first portions comprising material that is softer than that of at least one of the second portions.

When the rotational members are biased towards each other during a hose driving operation, the softer material allows the rotational axes of the respective rotational members to approach each other, whilst the approach is resisted by the harder material of the second portion. This allows a desirable high engagement force to be exerted by the external circumferentially extending second portions on the hose, so as to provide reliable traction.

A given rotational member may have a pair of external circumferentially extending first portions, one on each axial side of the external circumferentially extending second portion for hose engagement. Preferably, the first portions of both rotational members comprise the softer material. Preferably the second portions of both rotational members comprise the material which is less soft.

In order to bias the rotational members towards each other, a hydraulic cylinder may be used. This can provide the necessary biasing force, and can also serve to move the wheels apart into a stand by mode when no pushing in or pulling out force is required.

At least one of the rotational members may be driven by suitable means, such as a hydraulic motor. The other rotational member may be idle, i.e. caused to rotate by the driven member and not by its own drive.

The hose preferably passes vertically between the pair of rotational members. They are therefore preferably biased towards each other in a horizontal direction.

The drive system preferably comprises an anti-buckling guide arranged on the well side of the rotational members and through which the hose extends. A stuffing box, for example a dual stuffing box having two seal arrangements, may be provided below the anti-buckling guide. A lubricator may be provided below the stuffing box.

A load sensor may be provided to sense the force exerted by the pressure differential across the circumferential seal (e.g. the stuffing box) or the weight of the hose below the circumferential seal, whichever has the greatest value.

The load sensor can provide a check that the vertical force on the hose does not exceed a certain value.

A preferred method comprises guiding the hose from the drum towards the well, wherein the hose is guided into a downward direction towards the well by a guiding sheave. Preferably, the guiding sheave for the hose is located at a position higher than the hose drum.

Viewed from a third aspect, the invention provides a method of well intervention in which an intervention hose extends from a hose drum towards a well head, comprising guiding the hose from the drum towards the well head, wherein the hose is guided into a downward direction towards the well head by a guiding sheave. Preferably, the hose extends through the well head and into the well.

This is to be contrasted with known coiled tubing guiding systems, which involve the use of a goose neck which receives the coiled tubing coming upwardly directly from the reel and diverts it to the downward direction towards the well head. Such goose necks are usually of small curvature (large radius) in view of the stiffness of steel coiled tubing and are heavy and bulky items. By using a guiding sheave for the hose, in accordance with the third aspect of the invention, the use of such heavy and bulky equipment can be avoided.

Such an arrangement may be used in combination with the first or second aspect of the invention.

The guiding sheave may be a simple idle, non-driven sheave. Thus it may be caused to rotate by the hose and be not otherwise driven.

The hose may extend substantially vertically on the drum side of the guiding sheave. This may be achieved by positioning the drum directly below the guiding sheave.

The hose may extend from the drum to the guiding sheave via an intermediate sheave. The guiding sheave may be an upper sheave and the intermediate sheave may be a lower sheave. The intermediate sheave may be positioned directly below the guiding sheave. This is another way for the hose to extend substantially vertically on the drum side of the guiding sheave.

Thus, two sheaves, a first, or intermediate sheave, and a second, or guiding sheave, may be used to guide the hose. The intermediate sheave may be located at the same vertical level as the hose drum. The guiding sheave is positioned higher than the drum and is arranged to guide the hose into a downward direction towards the well head.

By arranging the hose to extend vertically on the drum side of the guiding sheave, the tension in the hose will generally not impart a horizontal force to the guiding sheave. This has the advantage that the structure supporting the guiding sheave, such as a tower on the deck of a vessel, need not be subjected to high horizontal loading due to tension in the hose. This is to be contrasted with traditional coiled tubing support systems involving the use of a goose neck, where the tubing on the reel side of the goose neck extends horizontally as well as vertically, whereby tension in the hose imparts horizontal loading to the goose neck supporting structure. The horizontal loading is applied at an elevated location and in some cases it is necessary to provide a stay to counteract such loading. The preferred arrangements can thus allow for the use of lighter equipment.

The well intervention methods described above in relation to the second or third aspects of the invention may be used on land or on sea based oil or gas rigs.

In accordance with the second aspect of the present invention, an injector is not used to pull the hose out of the well. Further, as discussed above, either no drive system is needed to drive the hose into the well or only a relatively light duty drive system is required. This makes it possible to provide, in relation to offshore well interventions, an intervention hose which extends from the sea surface to the sea floor without being contained in a riser (whether a conventional riser or an external coiled tubing acting as a flexible riser). Therefore, a preferred method of the second or third aspect of the invention, comprises an offshore well intervention, wherein the intervention hose is exposed directly to the ambient sea between the sea surface and the top of a subsea intervention stack.

The first aspect of the invention may be used in combination with either or both of the second or third aspects, with or without the various optional features described herein.

The hose drum which may be used in any aspect of the invention may for example be of a known type used for coiled tubing, for example the so-called small diameter "capillary" coiled tubing. If necessary, the hose drum may be modified to use a more powerful motor, in order to provide a sufficient pulling out capacity. Alternatively, a known wire line drum may be modified to include a swivel connection for a hose at its centre.

Preferably, a pressure tight swivel connection at the centre of the drum is connected to the end of the hose remote from the well, i.e. the innermost end of the hose, and the method comprises providing a pressure tight flow path of a fluid from a non-rotating end of the swivel connection to the outermost end of the hose while the hose drum is rotatable around the centreline of the swivel connection. A pump may be connected to the non-rotating end of the swivel connection, and the method may comprise providing a continuous flow of fluid under pressure from the pump to the outermost end of the hose.

It will be seen that low cost well interventions may be provided, whether land based or subsea. In preferred arrangements, the use of a heavy duty injector, or the use of a goose neck, or (in the subsea case) the use of a protective riser (whether of the traditional type or consisting of an outer coiled tubing), may be avoided in a well intervention. The intervention hose can provide hydraulic communication, unlike wireline interventions, but using equipment which is of lower cost than the usual coiled tubing equipment, and which is quicker to set up, with fewer personnel.

The present invention, in its various aspects, also extends to well intervention apparatus and the components of that apparatus as described herein.

Certain preferred embodiments of the invention in its various aspects will now be described, by way of example only, and with reference to the accompanying drawings, in which.

Figure 6A:
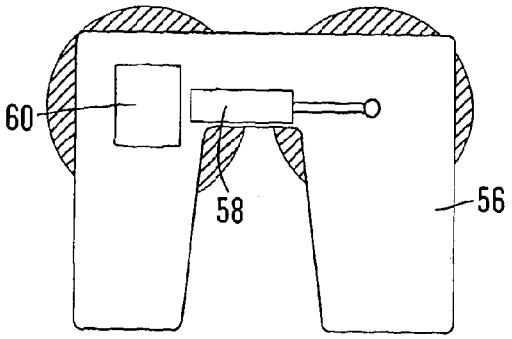
Figure 6B:
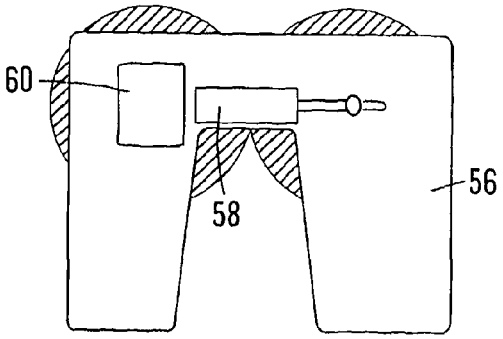
Figure 7A:
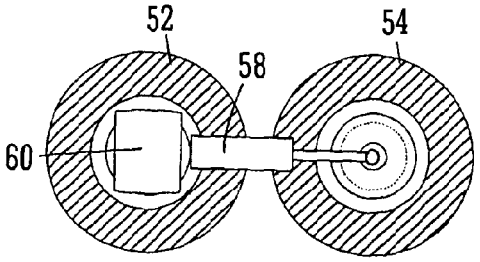
Figure 7B:
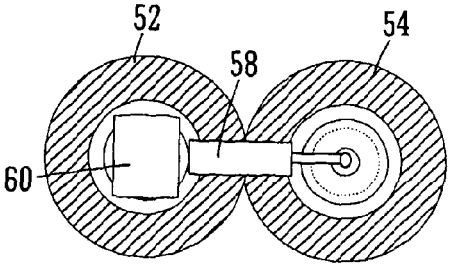

FIG. 6*a* is a partial elevation view of the drive system in a standby mode;

FIG. 6*b* is a view similar to that of FIG. 6*a* but with the support frame omitted;

FIG. 7*a* is a partial elevation view of the drive system in a drive mode; and FIG. 7*b* is a view similar to that of FIG. 7*a* but with the support frame omitted.

Figure 1:
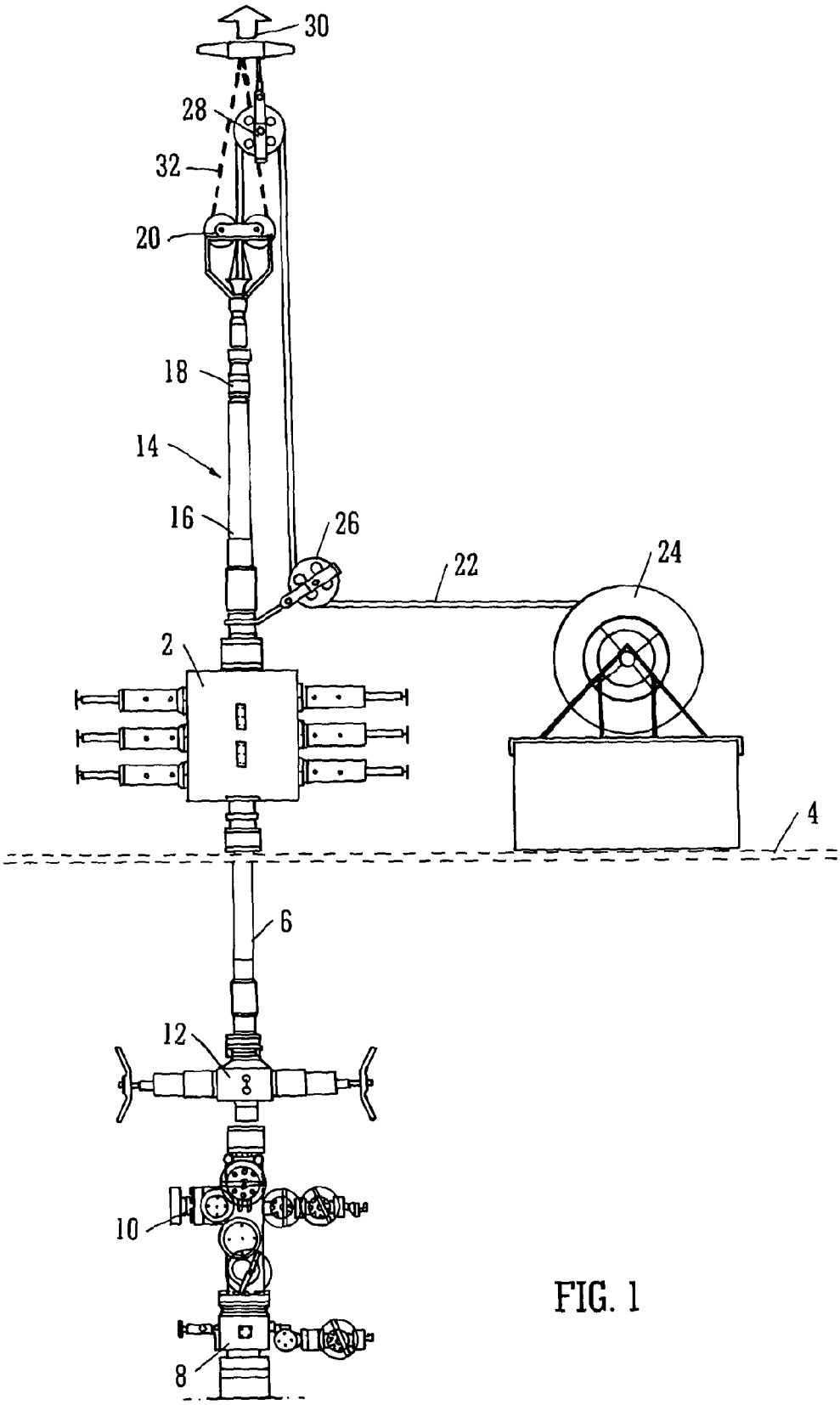
FIG. 1 is an overview of an intervention system according to the invention.

FIG. 1 shows an intervention set up for a well head on a fixed offshore platform or a land well. The well head is thus "dry" in the sense that it is not underwater and is either above the sea surface or is on land.

Referring to FIG. 1, this shows a blow-out preventer (BOP) 2 supported on a deck 4 positioned above a well head 8. Below deck a riser 6 extends downwardly to the wellhead. The well head 8 supports a tubing hanger and above the well head a production X-mas tree 10 is provided. Between the X-mas tree 10 and the riser 6 a shear-seal blow-out preventer 12 is provided.

An intervention stack 14 is provided above the (BOP) 2 on the deck 4. This consists of a lubricator 16 above the (BOP) 2, a dual stuffing box 18 above the lubricator and a snubbing drive system 20 above the dual stuffing box 18.

An intervention hose 22 is provided on a drum 24 which sits on the deck 4. The drum includes a pulling mechanism, which can also provide a back tension function. The pulling mechanism may be of the type used for wire line drums. The drum also includes a spooling mechanism and a high pressure swivel, as are known for coiled tubing intervention reels.

At the base of the intervention stack 14 a lower (or intermediate) sheave 26 is supported, and above the intervention stack 14 an upper, guiding sheave 28 is suspended from a mast, tower, crane or the like. Arrow 30 indicates the upward force provided by the mast or the like. A chain 32 also hangs off the support provided by the mast etc. to support the intervention stack 14.

The hose 22 extends from the drum 24 horizontally to the lower sheave 26, then vertically upwardly to the upper sheave 28 which guides it through 180° so as to extend downwardly towards the well head. Therefore tensions in the hose 22 between the lower sheave 26 and the upper sheave 28, and in the hose between the upper sheave and the remote end of the hose, apply only vertical forces to the sheave 28 which are supported by the mast or the like as shown by arrow 30. Tension in the hose in the run thereof between the drum 24 and the lower sheave 26 applies a horizontal force to the lower sheave 26. Since this is supported at the base of the intervention stack, the application of large horizontal forces higher up the mast or the like, which occur when using the goose neck system of conventional coiled tubing setups, can be avoided. Thus the need for stays or other structure to provide a reaction to such horizontal forces can be minimised or avoided.

From the upper sheave 28 the hose 22 passes downwardly through the drive system 20, the stuffing box 18, the lubricator 16, the (BOP) 2 and towards the well head.

Figure 2:
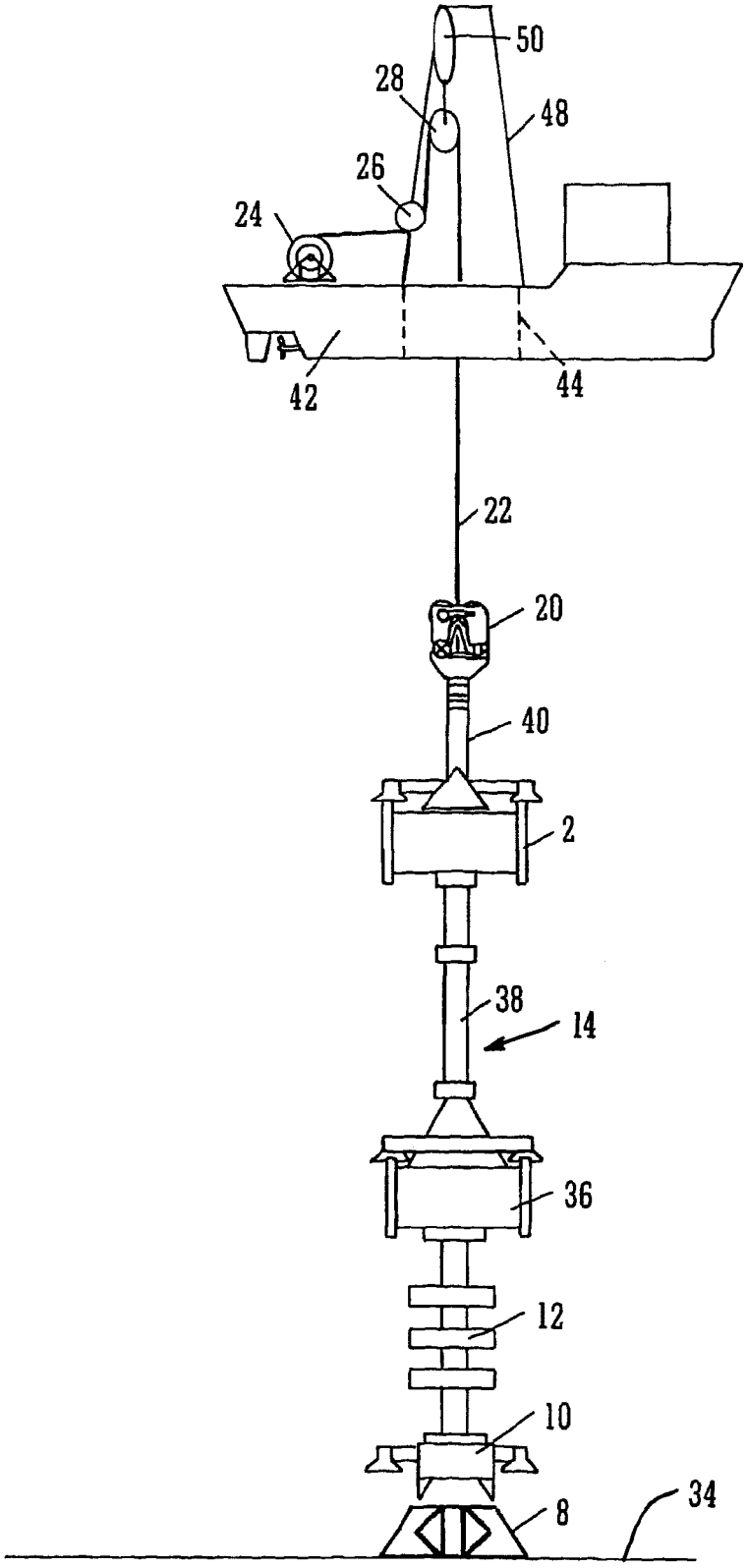
FIG. 2 is another overview, showing an intervention system according to the invention provided from a floating vessel.

FIG. 2 shows a system similar to that of FIG. 1 and like reference numerals are used. The system shown is for offshore well intervention. In this case the intervention stack 14 is provided on the sea bed. Considering the components upwardly from the sea bed 34, there are provided a well head and production X-mas tree 8, a production X-mas tree interface 10, a blow-out preventer 12, a lower lubricator package 36 having an emergency disconnect function, lubricator section 38, a blow-out preventer 2 for the intervention hose, and an interface connector 40 between the blow-out preventer 2 and the drive system 20. The drive system 20 and the components below it are all under water.

On the sea surface a floating mono-hull vessel 42 is provided with a moon pool opening 44 through which an intervention hose 22 extends vertically. The intervention hose is supplied from a drum 24 on the deck of the vessel via a lower sheave 26. This sheave is fixed to the vessel's structure. An upper sheave 28 is provided above the lower sheave 26. The upper sheave 28 is supported from a mast 48 of the vessel 42 via a heave compensation system 50. In the embodiment of FIG. 2, the hose 22 extends from the vessel 42 to the intervention package 14 on the sea bed 34 without being contained within a riser. It is therefore a riserless hose intervention system. The hose 22 is exposed directly to ambient sea and provides a hydraulic connection from the vessel through to the bottom end of the hose.

The drive system 20 will now be described in further detail with reference to FIGS. 3-7.

Figure 3:
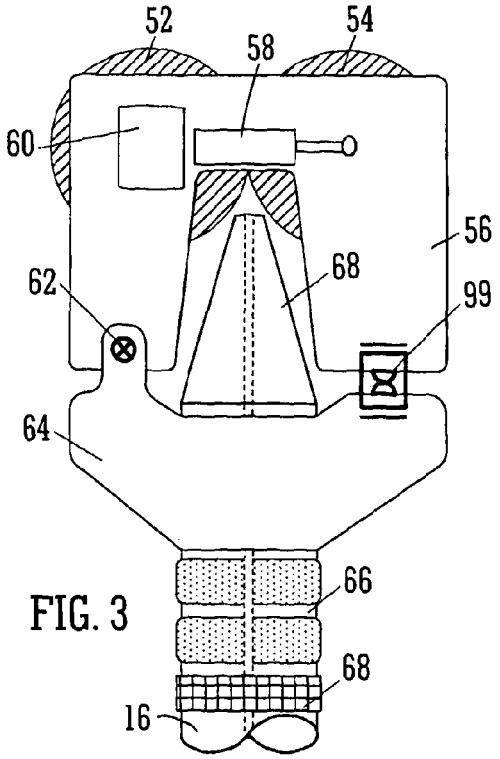
FIG. 3 is a schematic elevation view of the hose injector or drive system.
Figure 4:
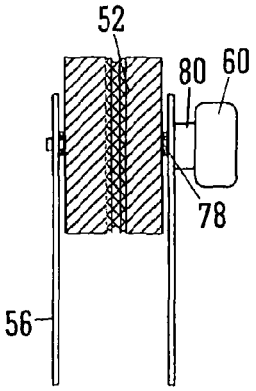
FIG. 4 is a partial side elevation view of the drive system.

FIG. 3 shows a pair of rotatable members in the form of wheels 52, 54 rotatably supported on a support frame 56. As seen in FIG. 4 a shaft and bearing assembly 78 is provided for each wheel. A hydraulic cylinder 58 is provided to bias the wheels towards each other and a hydraulic motor 60 is provided to drive one of the wheels 52. A failsafe brake 80 is provided between the hydraulic motor and the wheel and is arranged to be releasable by hydraulic motor pressure. The support frame 56 is pivotally mounted at pivot 62 with respect to a support bracket 64 fixed to a dual stuffing box 66 which connects at 68 to the top of a lubricator 16. A load sensor 99 is provided between the support bracket 64 and the support frame 56 in order to measure the load applied by the pressure differential across the stuffing box 66 or the weight of the hose below the stuffing box 66, whichever has the greatest value of the two.

Below the wheels 52, 54 an anti-buckling guide 68 is provided for the hose 22 (not shown in FIG. 3), supported on the support bracket 64.

Figure 5:
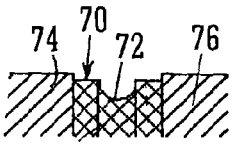
FIG. 5 is an enlarged view of part of the wheel shown in FIG. 4.

Referring to FIGS. 4 and 5, the wheel 52 has a pair of external circumferentially extending first portions 74 and 76 which are axially spaced apart. Between the first portions 74, 76 there is provided an external circumferentially extending second portion 70 having formed therein a circumferential groove 72 for engaging a hose 22 (not shown). The diameter of the first portions 74, 76 is slightly larger than that of the second portion 70. The first portions are made of a material which is softer than the material from which the second portion is made. For example, both first and second portions may be made of polyurethane with different hardnesses. The other wheel 54 has a similar construction to that of wheel 52.

When the two wheels are urged towards each other by the hydraulic cylinder 58 their respective first portions, with the larger diameters than the second portions, are brought into contact and the material of the first portions is compressed. A drive provided by hydraulic motor 60 may thus be transmitted from wheel 52 to wheel 54. As the material of the first portions compresses and the rotational axes of the wheels are brought closer together the grooves 72 of the respective wheels firmly engage the outside of the hose 22. The harder material of the second portions provides an effective frictional grip on the hose 22 so that it can be driven into the well through the stuffing box 18. In this way, if the well is at high pressure creating a pressure differential across the stuffing box then the drive system 20 serves to provide the necessary driving or snubbing force.

The drive mode of the drive system 20 is shown in FIGS. 7*a* and 7*b* (the hose 22 is not shown).

FIGS. 6*a* and 6*b* show the drive system 20 when it is in standby mode, with the wheels 52 and 54 spaced apart. It may be in this mode if well pressure is low and the weight of the hose, any tool string and any weights at its ends, are sufficient to overcome the snubbing force. It may also be in the standby mode when the hose 22 is being pulled from the well, because the necessary pulling force may be provided by the pulling mechanism of the drum 24, assisted by well pressure creating an upward force on the hose.

The invention claimed is:

1. A method of well intervention in a subsea well having a wellhead on the sea floor, in which an intervention hose extends downwardly through the sea from a hose drum installed on a vessel on the sea surface into the well through a subsea intervention stack installed on the wellhead at the sea floor, and in which the intervention hose is exposed directly to the ambient sea between the vessel and the top of the subsea intervention stack, wherein the intervention hose is completely non-metallic or has a metal content of less than 50% by volume, wherein the hose is driven out of the well without the use of an injector by pulling the hose out of the well with the hose drum, wherein a guiding sheave for the hose is located at a position higher than the hose drum and is arranged to guide the hose into a downward direction towards the well, and wherein the hose extends substantially vertically on the drum side of the guiding sheave.

2. A method as claimed in claim 1, wherein the hose extends through a seal which seals circumferentially round the outside of the hose, and the method comprises using a drive system to push the hose through the seal.

3. A method as claimed in claim 2, wherein the drive system comprises a pair of rotational members biased towards each other with the hose therebetween.

4. A method as claimed in claim 3, wherein the rotational members engage each other by external circumferentially extending first portions and engage the hose by external circumferentially extending second portions, at least one of the first portions comprising material that is softer than that of at least one of the second portions.

5. A method as claimed in claim 3, wherein the drive system comprises an anti buckling guide arranged on the well side of the rotational members and through which the hose extends.

6. A method as claimed in claim 1, wherein the hose extends from the drum to the guiding sheave via an intermediate sheave.

7. A well intervention method as claimed in claim 1, wherein a pressure tight swivel connection in the centre of the drum is connected to the innermost end of the hose, the method comprising providing a pressure tight flow path of a fluid from a non-rotating end of the swivel connection to the outermost end of the hose while the hose drum is rotatable around the centerline of the swivel connection.

8. A method of well intervention in which an intervention hose extends from a hose drum and into a well, comprising guiding the hose from the drum towards the, well wherein the hose is guided into a downward direction towards the well by a guiding sheave, wherein the guiding sheave is located at a higher position than the hose drum, wherein the hose extends substantially vertically on the drum side of the guiding sheave, wherein the hose is driven out of the well without the use of an injector by pulling the hose out of the well with the hose drum, and wherein the intervention hose is completely non-metallic or has a metal content of less than 50% by volume.

9. A method as claimed in claim 8, wherein the hose extends through a seal which seals circumferentially round the outside of the hose, and the method comprises using a drive system to push the hose through the seal.

10. A method as claimed in claim 9, wherein the drive system comprises a pair of rotational members biased towards each other with the hose therebetween.

11. A method as claimed in claim 10, wherein the rotational members engage each other by external circumferentially extending first portions and engage the hose by external circumferentially extending second portions, at least one of the first portions comprising material that is softer than that of at least one of the second portions.

12. A method as claimed in claim 9, wherein the pushing force provided by the drive system is no more than 20,000 Newtons.

13. A method as claimed in claim 8, wherein the hose extends from the drum to the guiding sheave via an intermediate sheave.

14. A method as claimed in claim 13, wherein the intermediate sheave is located below the guiding sheave such that the hose extends substantially vertically from the intermediate sheave to the guiding sheave.

15. A method of well intervention in a subsea well having a wellhead on the sea floor, in which an intervention hose extends downwardly through the sea from a hose drum installed on a vessel on the sea surface into the well through a subsea intervention stack installed on the wellhead at the sea floor, and in which the intervention hose is exposed directly to the ambient sea between the vessel and the top of the subsea intervention stack and has a tool string attached to a downhole end of the intervention hose, wherein the intervention hose is completely non-metallic or has a metal content of less than 50% by volume, and wherein the hose is driven out of the well without the use of an injector by pulling the hose out of the well with the hose drum, the method comprising driving the hose into the well using at least one of additional weighting, additional to the weight of the intervention hose and the tool string, and a tractor.

* * * * *